United States Patent [19]

Hutchins, Jr. et al.

[11] 4,182,244

[45] Jan. 8, 1980

[54] MODULAR DISPLAY DEVICE

[75] Inventors: Ferris L. Hutchins, Jr., Doraville; James L. Gebhardt, Roswell, both of Ga.

[73] Assignee: The Mead Corporation, Dayton, Ohio

[21] Appl. No.: 957,296

[22] Filed: Nov. 2, 1978

[51] Int. Cl.[2] ..... A47B 7/00; B65D 19/00; A47B 87/00

[52] U.S. Cl. ..... 108/91; 108/53.1; 206/511; 206/512; 211/194; 248/174; 312/108

[58] Field of Search ..... 108/91, 53.1, 111; 248/165, 174; 211/126, 194; 297/442; 312/107, 108, 111; 206/511, 512, 509

[56] References Cited

U.S. PATENT DOCUMENTS

| | | | |
|---|---|---|---|
| 2,125,813 | 8/1938 | Roscoe | 312/108 |
| 2,279,864 | 4/1942 | Eide | 248/165 |
| 3,300,245 | 1/1967 | Rumble | 297/442 X |
| 3,331,634 | 7/1967 | Harrison, Jr. | 297/442 |
| 3,603,656 | 9/1971 | Ferman | 297/442 X |
| 3,653,734 | 4/1972 | Ungaro | 312/107 |
| 3,834,324 | 9/1974 | Lang | 108/91 |
| 3,853,073 | 12/1974 | Flum | 108/53.1 X |
| 4,074,810 | 2/1978 | Juergens et al. | 211/126 |
| 4,082,356 | 4/1978 | Johnson | 297/442 |

*Primary Examiner*—James T. McCall
*Attorney, Agent, or Firm*—Walter M. Rodgers; Walter A. Rodgers

[57] ABSTRACT

A display device of modular construction which preferably is formed of heavy duty paperboard includes a plurality of shelf units (1, 2 and 3) which are adapted for stacking one atop the other and in which each shelf unit comprises a rectangular horizontal platform (4, 27, 49) to the front edges of each of which downwardly extending leg panels (5, 6, 29, 31, 51, 52) are foldably joined, each of which is provided with vertically disposed open ended slits (6, 13, 14, 36, 37, 38, 58, 59 and 60) and to the side edges of each of which upwardly extending leg panels (9, 10, 32, 34, 54, and 55) are foldably joined each of which is provided with vertically disposed open ended slits (17, 18, 19, 20, 42, 43, 44, 45, 62, and 63), apertures (25, 46, 61) being formed in the downwardly extending leg panels for receiving reinforcing bars (24) and the vertically disposed slits in the upwardly extending leg panels of each shelf unit being arranged to cooperate with the vertical slits of the downwardly extending leg panels of associated shelf units above in order to provide a stable and mechanically strong stack of shelf units.

8 Claims, 8 Drawing Figures

MODULAR DISPLAY DEVICE

TECHNICAL FIELD

This invention relates to a collapsible display device formed of a plurality of modular units constructed of die cut paperboard preferably and which may be assembled to form economical low cost units of various heights and capacities.

BACKGROUND ART

Known display devices are ordinarily constructed of metal, wood, or plastic components and are expensive to build but are not ordinarily constructed in such a way that their overall height may be adjusted to suit the requirements of the user. Ordinarily such devices are used in supermarkets and in other point-of-purchase locations.

DISCLOSURE OF THE INVENTION

The invention in a preferred form comprises a display device formed of a plurality of shelf units each of which may include a generally rectangular horizontally disposed platform to the front and rear edges of which a pair of downwardly extending leg panels are foldably joined and to the side edges of which a pair of upwardly extending leg panels are foldably joined. Each leg panel of the upwardly and downwardly extending leg panels is provided near its end edges with a pair of vertically disposed open ended slits the open ends of which are disposed at the end edges of the associated leg panels. Thus one shelf unit may be stacked atop another shelf unit by simply aligning the open ended slits of the upwardly extending leg panels of a lower unit with the open ended slits formed in the downwardly extending leg panels of an upper platform so as to provide an assembly of vertically spaced shelves, each platform constituting a shelf. The lowermost shelf in it is arranged with its downwardly extending leg panels disposed in overlying relation with a pair of bracing panels which also are provided with slits aligned with the slits in the downwardly extending leg panels and preferably a reinforcing bar is inserted through aligned apertures formed in the downwardly extending leg panels so as to afford reinforcement for the platform to which the downwardly extending leg panels are foldably joined. The uppermost shelf unit is arranged so that its upwardly extending leg panels are provided with slits which receive corresponding slits formed in a bracing panel disposed at the rear of the unit. Preferably each platform is provided along its rear edge with at least one locking aperture for receiving a locking tab formed on the lower edge of the overlying downwardly extending rear leg or bracing panel as the case may be. Preferably all of the leg panels are provided with cutaway central portions except the downwardly extending rear leg panels which thus provide a closed back for the stand when assembled.

BRIEF DESCRIPTION OF THE DRAWINGS

In the drawings,

FIG. 7 is a perspective view of a shelf unit which is specially adapted for use as the uppermost shelf unit; and in which

BEST MODE FOR CARRYING OUT THE INVENTION

Figure 1:
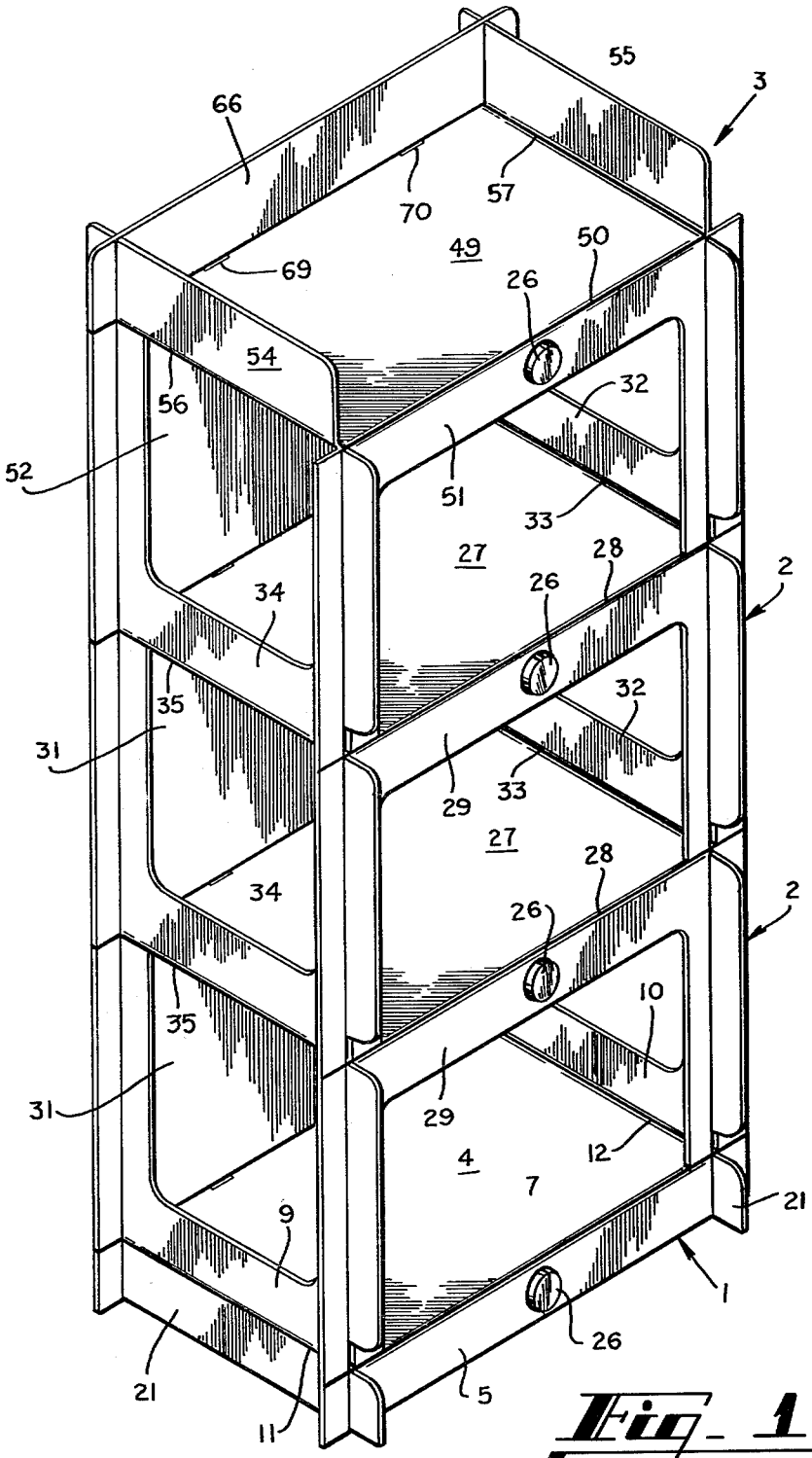
FIG. 1 is a perspective view of a display device in completely assembled form and which is constructed according to the invention.

With reference of FIG. 1, the numeral 1 generally designates the lowermost shelf unit while the numeral 2 generally designates two identical intermediate shelf units and the numeral 3 generally designates a shelf unit which is specially adapted for use as the uppermost shelf unit.

Figure 2:
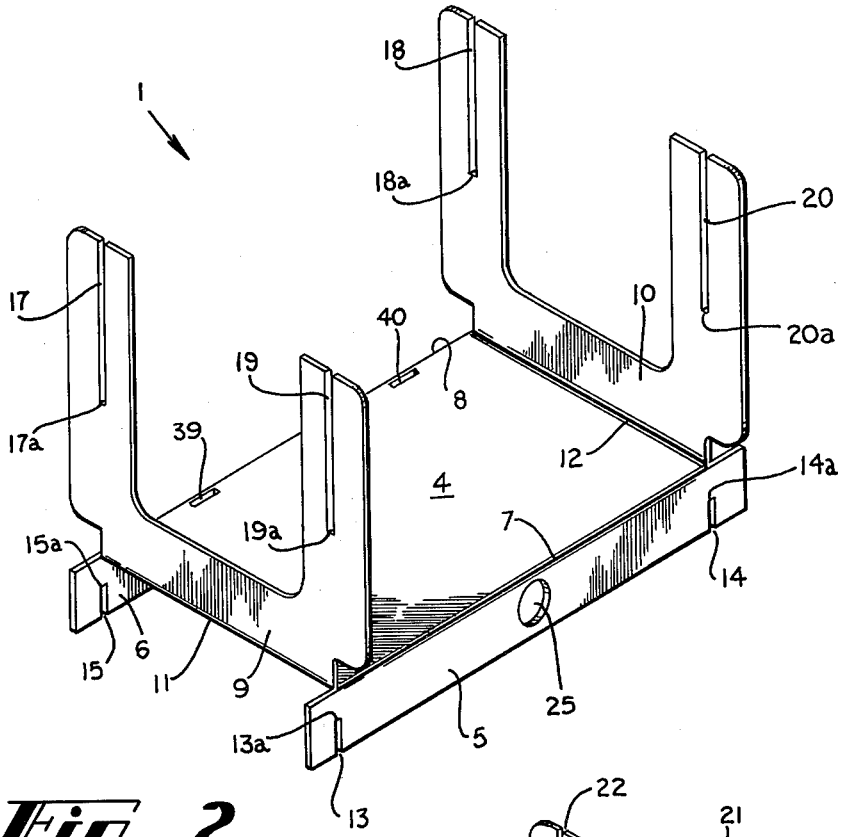
FIG. 2 is a perspective view of a shelf unit which is specially adapted to constitute the lowermost shelf of a display stand formed according to the invention.

In FIG. 2 the lowermost shelf unit 1 is shown in perspective and in set-up condition and comprises a rectangular platform 4 to the front and rear edges of which a pair of downwardly extending leg panels 5 and 6 are foldably joined along fold lines 7 and 8. A pair of upwardly extending leg panels 9 and 10 are foldably joined respectively to the side edges 11 and 12 respectively of platform 4. Vertically disposed open ended slots 13 and 14 are formed in downwardly extending leg panel 5 while similar slots are formed in downwardly extending leg panel 6 only one of which is observable in FIG. 2 and is designated at 15. The open ends of the slots 13, 14, 15 are at the lower edges of the downwardly extending leg panels 5 and 6 as is obvious in FIG. 2.

In similar fashion open ended slots 17, 18, 19, and 20 are formed in leg panels 9 and 10 and the open ends of these slots are disposed at the upper edges of the leg panels. As is obvious from FIG. 2, both leg panels 9 and 10 are provided with central cutaway areas disposed between the slots 17, 19, and 18, 20. Shelf units formed according to this invention preferably are constructed from strong heavy duty paperboard.

Figure 3:
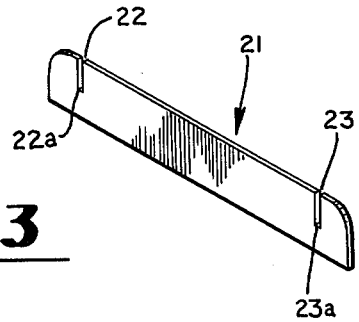
FIG. 3 is a perspective view of a bracing panel specially adapted for use in conjunction with the shelf unit shown in FIG. 2.

For bracing and holding the leg panels 5 and 6 in position, bracing panels such as that indicated at 21 in FIG. 3 are provided according to one feature of the invention. Bracing panel 21 is provided with a vertically disposed slit 22 at one end and a similar slit 23 at the other end. In assembling the unit, panel 21 is arranged with its slit 22 in coincidence with the slit 15 in downwardly extending leg panel 6 and with its slit 23 in coincidence with the slit 13 formed in downwardly extending panel 5. The closed ends (22*a* and 23*a*) of the slits in the bracing panel 21 and (13*a* and 15*a*) in the panels 5 and 6 are disposed in close juxtaposition to each other and preferably are in load bearing contact though contact is not necessary in practicing the invention. In like fashion a bracing panel 21 is arranged with its slit 23 in cooperative engagement with slit 14 in downwardly extending leg panel 5 and with its slit 22 in cooperative engagement with a slit not shown in FIG. 2 but which is formed in the right hand end of panel 6 as is obvious.

In order to provide reinforcement for the panel 4, a reinforcing rod designated by the numeral 24 is provided and is arranged for insertion into the aperture 25 formed in leg panel 5. A similar aperture, not observable, in FIG. 2 is formed in downwardly extending leg panel 6 and is in alignment with the aperture 25. The diameter of the aperture 25 and of the associated aperture in panel 6 is equal approximately to the outside diameter of reinforcing rod 24 so that the parts occupy a snug and secure relationship.

Figure 5:
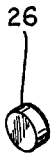
FIG. 5 is a perspective view of an end cap for closing the ends of the bracing rod of FIG. 4.
Figure 4:
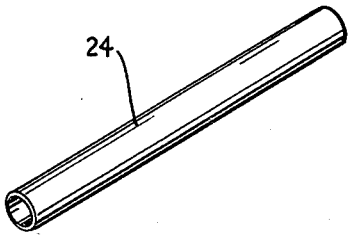
FIG. 4 is a perspective view of a bracing rod.

For the purpose of closing the ends of reinforcing rod 24, closure caps such as are indicated at 26 and as shown in FIG. 5 may be used if desired.

Figure 6:
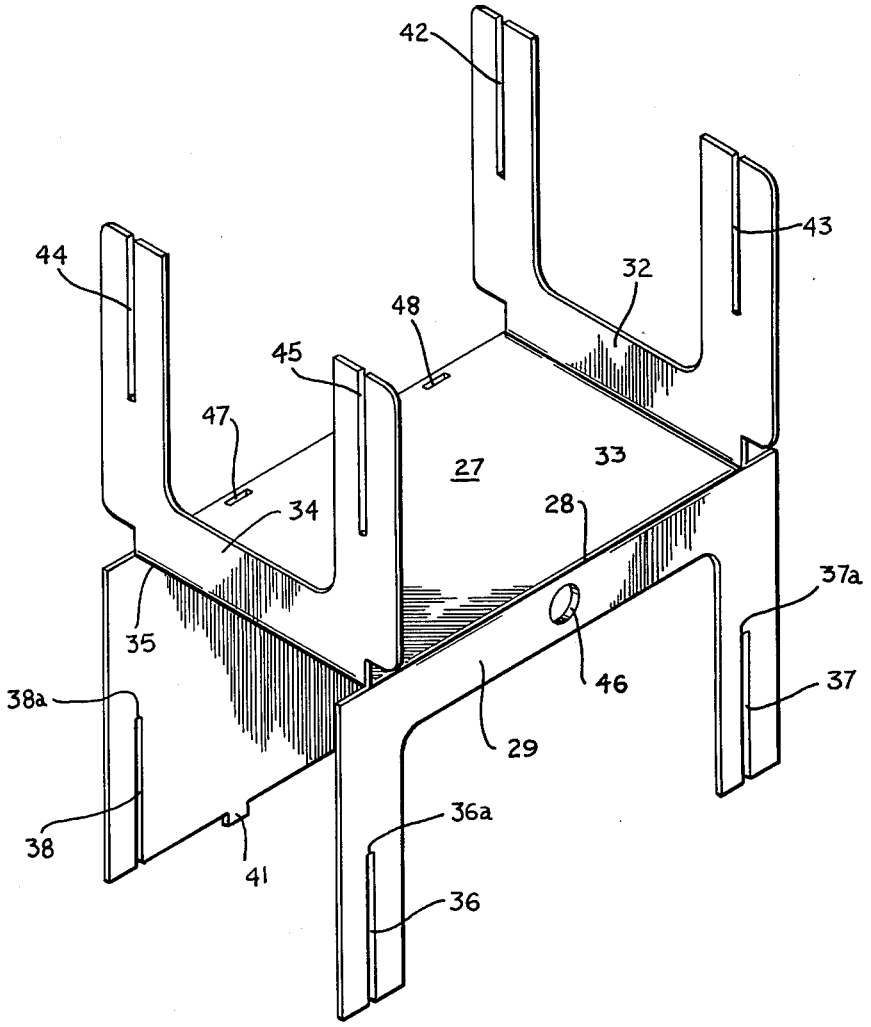
FIG. 6 is a perspective view of a shelf unit which is specially adapted to constitute an intermediate shelf disposed above the lowermost shelf and underneath the uppermost shelf unit.

Intermediate units such as are designated by the numeral 2 in FIG. 1 are shown in perspective set-up condition in FIG. 6. Shelf unit 2 comprises a rectangular platform 27 to the front edge 28 of which a downwardly extending leg panel 29 is foldably joined and to the rear edge 30 of which a downwardly extending leg panel 31 is foldably joined. Upwardly extending leg panel 32 is foldably joined along side edge 33 to platform panel 27 while upwardly extending leg panel 34 is foldably joined along end edge 35 to platform 27.

Open ended vertical slits 36 and 37 are formed near the end edges of downwardly extending leg panel 29, the open ends of slits 36 and 37 being disposed at the lower edges of leg panel 29. Vertically disposed open ended slit 38 is formed near the end edge of leg panel 31 and a similar slit not shown in FIG. 6 is formed in leg panel 31 near the right hand end thereof.

When stacked atop the shelf unit 1, the shelf unit 2 is arranged with slits 36 and 37 in cooperative aligned relation with the slits 19 and 20 and with the slit 38 and the corresponding slit in leg panel 31 arranged in coincidence with slits 17 and 18 respectively. The closed ends 36*a*, 37*a* and 38*a* of the slits in leg panels 29 and 31 are disposed in close juxtaposition to the closed ends 19*a*, 20*a*, 17*a* and 18*a* of the slits formed in upwardly extending leg panels 9 and 10. If desired these closed ends may be in load bearing contact with each other. For example the closed end 17*a* of slit 17 may be in close juxtaposition to or in load bearing contact with the closed end 38*a* of slit 38. In similar fashion the remaining slits are similarly interrelated as is obvious.

For the purpose of interlocking the units 1 and 2 and for providing a closed back for the display unit, a pair of locking apertures 39 and 40 are provided in platform 4 near the rear edge thereof and these locking apertures receive corresponding locking tabs such as that indicated at 41 which is formed on the lower edge of downwardly extending leg panel 31. A tab similar to 31 but not observable in FIG. 6 is arranged on the lower edge of downwardly extending leg panel 31 and is inserted into the locking aperture 40. For some applications of the invention only one locking tab and its associated aperture may suffice.

In order to condition the unit 2 for reception of similar shelf units stacked thereabove, upwardly extending leg panel 32 is provided with vertically disposed open-ended slits 42 and 43 while upwardly extending leg panel 34 is provided with open-ended vertically disposed slits 44 and 45. As is apparent from FIG. 6, the slits 42–45 are arranged with their open ends at the upper edges of leg panels 32 and 34.

It will be obvious that one or a plurality of units such as that indicated by the numeral 2 and shown in FIG. 6 may be stacked one atop another to provide a display of any desired height within limits. As shown in FIG. 1 two units such as are designated by the numeral 2 and shown in FIG. 6 are employed. Obviously only one such unit could be used or if desired three or more units could be stacked one atop another. Units 2 are provided with apertures 46 in downwardly extending leg panel 29 and with a similar aligned aperture not observable in FIG. 6 but which is formed in the upper portion of leg panel 31 so that a reinforcing rod such as 24 may be inserted through the apertures to afford reinforcement for platform 27. Locking apertures 47 and 48 are formed in platform 27 near the rear edge 30 thereof and serve to receive locking tabs formed on downwardly extending leg panels of a unit disposed above platform 27 such as the locking tabs 39 and 40 as shown in FIG. 2.

Figure 7:
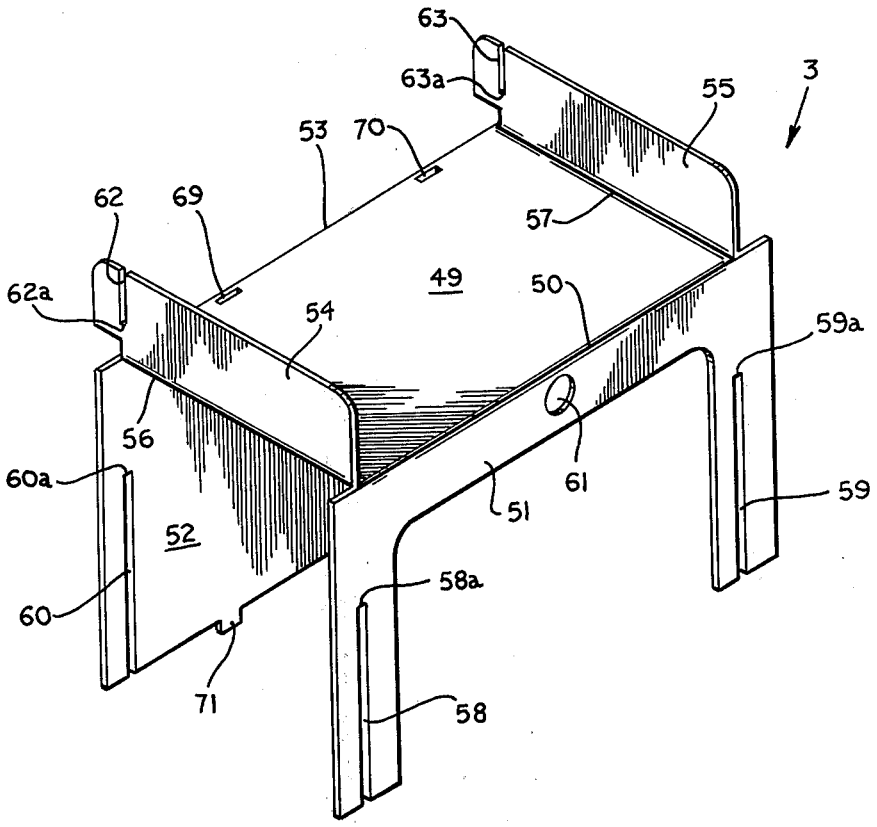

The shelf unit generally designated by the numeral 3 in FIG. 1 is shown in perspective set-up condition in FIG. 7 and comprises a platform 49 to the front edge 50 of which downwardly extending leg panel 52 is foldably joined. Downwardly extending leg panel 52 is foldably joined to panel 49 along the rear edge 53 thereof. Upwardly extending leg panels 54 and 55 are foldably joined respectively to the ends 56 and 57 of platform 49.

Downwardly extending leg panel 51 is provided with open-ended slits 58 and 59 while downwardly extending leg panel 52 is provided with an open ended slit 60 and another slit not observable in FIG. 7 but which is located near the right hand edge of leg panel 52 as is obvious. Leg panel 52 is provided with an aperture 61 and leg panel 52 is provided with a similar aperture near the fold line 53 for receiving a reinforcing bar such as 24. The open ends of the slits 58, 59, 60 and the slit not observable in FIG. 7 are disposed at the lowermost edges of leg panels 51 and 52.

Figure 8:
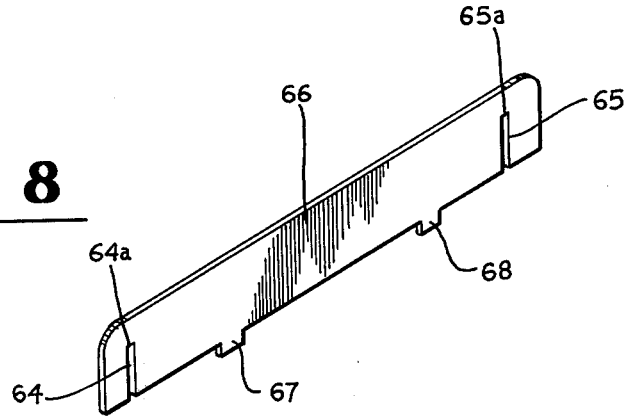
FIG. 8 is a perspective view of a bracing panel which is specially adapted for use in conjunction with the uppermost shelf unit of FIG. 7.

Upwardly extending leg panels 54 and 55 are provided with open-ended slits 62 and 63 which are arranged to cooperate with slits 64 and 65 formed in bracing panel 66 as shown in FIG. 8. The closed ends 64*a* and 65*a* of the slits 64 and 65 are disposed in close juxtaposition to or in contact with the closed ends 62*a* and 63*a* of the slits 62 and 63. Locking tabs 67 and 68 are formed along the lower edge of bracing panel 66 and are inserted into the locking apertures 69 and 70 respectively formed in platform panel 49 near the rear edge 53 thereof. In like fashion locking tabs 71 and an associated locking tab not shown in FIG. 7 are formed along the lower edge of downwardly extending leg panel 52. Locking tab 71 is inserted into locking aperture 47 of shelf unit 2 and the locking tab not observable in FIG. 7 is inserted into locking aperture 48 of shelf unit 2.

From FIGS. 6 and 7 it is obvious that the downwardly extending leg panels 31 and 52 are not formed with cutaway central areas. This arrangement results in a stand as shown in FIG. 1 which is provided with a closed back. On the other hand the downwardly extending front leg panels 29 of unit 2 and 51 of unit 3 are provided with cutaway areas disposed between the slits 36 and 37 in unit 2 and the slits 58 and 59 in unit 3. Thus access to the shelf platforms 4 and 27 is provided.

In similar fashion all of the upwardly extending leg panels such as 9, 10 of unit 1, 32 and 34 of unit 2 are provided with cutaway central areas disposed between their vertically disposed slits so as to afford access to the shelf platforms 4 and 27 as is obvious.

While it is ordinarily desirable to employ units such as 1, 2 and 3 in a particular stand, it may be desirable to eliminate unit 2 and simply to stack unit 3 atop unit 1 as is obvious.

INDUSTRIAL APPLICABILITY

By this invention, a display stand is provided which is rugged and durable due in part to the fact that the leg panels which extend downwardly are disposed in interlocked perpendicular relationship to leg panels which extend upwardly and which thus provide what amounts to corner posts at each corner of the stand which are in effect reinforced from all sides. Furthermore the reinforcement of the platforms such as 4, 27 and 49 by the reinforcing rods such as 24 serves to render the supporting surfaces durable and mechanically strong.

This invention is primarily intended to provide economical, readily adaptable display units which may be assembled and disassembled and which may be low in height or of greater height as may be required for a particular application.

The embodiments of the invention in which an exclusive property or privilege is claimed are defined as follows:

1. A display device comprising a first rectangular horizontal platform (4), a pair of upwardly extending leg panels (9, 10) foldably joined respectively to the side edges of said first platform and in substantially normal relation thereto, a pair of substantially vertical open ended slits (17,19,18,20) formed in each leg panel of said pair of upwardly extending leg panels and respectively disposed adjacent the end edges thereof with their open ends at the upper edges of said upwardly extending leg panels, a second rectangular horizontal platform (27) disposed in spaced relation above said first platform, a pair of downwardly extending leg panels (29,31) foldably joined respectively to the front and rear edges of said second platform and in substantially normal relation thereto, a pair of substantially vertical open-ended slits (36,37,38) formed in each leg panel of said pair of downwardly extending leg panels and respectively disposed adjacent the end edges thereof with their open ends at the lower edges of said downwardly extending pair of leg panels, the slits (17–20) of said pair of upwardly extending leg panels being aligned with the corresponding slits (36–38) in said pair of downwardly extending leg panels and the closed ends of the slits (17*a*,18*a*,19*a*,20*a*) in said pair of upwardly extending leg panels being in close juxtaposition with the closed ends of the slits (38*a*,36*a*,37*a*) in said pair of downwardly extending leg panels.

2. A display device according to claim 1 wherein a pair of downwardly extending leg panels (5,6) are foldably joined respectively to the front and rear edges of said first platform (4) and disposed in substantially normal relation thereto, a pair of open-ended vertical slits (15–15) formed in each leg panel of said downwardly extending leg panels foldably joined to said first platform and respectively disposed adjacent the end edges thereof, and a pair of bracing panels (21) each having an open-ended slit (22,23) adjacent each end thereof and being arranged in vertical planes, said bracing panels being arranged with the closed ends (22*a*,23*a*) of the slits therein in close juxtaposition with the closed ends (15*a*,13*a*,14*a*) of the corresponding slits in said downwardly extending pair of leg panels foldably joined to said first platform.

3. A display device according to claim 2 wherein the open ends of said slits (13,14,15) formed in said downwardly extending leg panels (5,6) foldably joined to said first platform (4) are arranged with their open ends at the bottom edges of said leg panels and wherein the slits (22,23) formed in said bracing panels are arranged with their open ends at the top edges of said bracing panels.

4. A display device according to claim 2 wherein aligned apertures (25) are formed in each pair of said downwardly extending leg panels (5,6,29,31) foldably joined to said first (4) and second (27) platforms and wherein a reinforcing bar (24) is disposed in each pair of apertures and immediately underneath the associated platform (4,27) so as to afford support therefor.

5. A display device according to claim 1 wherein said each leg panel (9,10) of said pair of upwardly extending leg panels is formed with a cutaway area between the slits (17,19,18,20) formed therein.

6. A display device according to claim 1 wherein only the one (29) of said pair of downwardly extending leg panels (29,31) which is foldably joined to the front edge of said second platform is formed with a cutaway area between the slits (36,37) formed therein.

7. A display device according to claim 1 wherein at least one locking aperture (39,40) is formed in said first platform (4) adjacent the rear edge thereof and wherein at least one locking tab (41) is formed on the lower edge of the rear one (31) of said downwardly extending leg panels foldably joined to said second platform (27) and in vertical alignment with said locking aperture, said locking tab being disposed in said locking aperture.

8. In a display stand, a shelf unit comprising a rectangular platform (27), a first pair of leg panels (32,34) foldably joined respectively to the side edges of said platform and extending upwardly therefrom in substantially normal relation thereto, a second pair of leg panels (29,31) foldably joined respectively to the front and rear edges of said platform and extending downwardly therefrom in substantially normal relation thereto, each of said leg panels being provided with a cutaway central portion except the one (31) of said downwardly extending leg panels which is foldably joined to the rear edge of said platform (27), a pair of substantially vertical open ended slits (36,37,38,42,43,44,45) formed in and extending through each leg panel and respectively disposed with their open ends at the end edges thereof, at least one locking aperture (47,48) formed in said platform (27) adjacent the rear edge thereof and at least one locking tab (41) formed on the bottom edge of the rear one (31) of said downwardly extending leg panels.

* * * * *